US007581492B2

(12) United States Patent
Roberts, Jr. et al.

(10) Patent No.: US 7,581,492 B2
(45) Date of Patent: Sep. 1, 2009

(54) SILK SCREEN SAMPLE APPARATUS WITH INTEGRATED HEAT PRESS DEVICE

(75) Inventors: Robert Glyn Roberts, Jr., Torrance, CA (US); Jack John Meola, Huntington Beach, CA (US); Rodolfo Antonio Mancia, Covina, CA (US)

(73) Assignee: Fortune Fashion Industries, LLC, Vernon, CA (US)

( * ) Notice: Subject to any disclaimer, the term of this patent is extended or adjusted under 35 U.S.C. 154(b) by 174 days.

(21) Appl. No.: 11/871,130

(22) Filed: Oct. 11, 2007

(65) Prior Publication Data

US 2009/0095173 A1 Apr. 16, 2009

(51) Int. Cl.
*B05C 17/04* (2006.01)

(52) U.S. Cl. ..... 101/123; 101/126; 101/488

(58) Field of Classification Search ..... 101/114, 101/115, 123, 126, 129, 487, 488
See application file for complete search history.

(56) References Cited

U.S. PATENT DOCUMENTS

| | | | | |
|---|---|---|---|---|
| 4,671,174 | A * | 6/1987 | Tartaglia et al. | 101/115 |
| 5,970,874 | A * | 10/1999 | Bill | 101/488 |
| 6,983,690 | B2 * | 1/2006 | Eppinger | 101/287 |
| 7,520,219 | B2 * | 4/2009 | Cowan | 101/129 |

* cited by examiner

*Primary Examiner*—Ren Yan
(74) *Attorney, Agent, or Firm*—Marc E. Hankin; Kevin E. Schraven; Hankin Patent Law, APC

(57) ABSTRACT

This invention relates to a combination silk screen and heat press apparatus, which is configured such that silk screening and heat pressing operations may be performed on an article, such as a garment, using the same apparatus without the need to remove or reposition the article.

21 Claims, 4 Drawing Sheets

SILK SCREEN SAMPLE APPARATUS WITH INTEGRATED HEAT PRESS DEVICE

FIELD OF INVENTION

This invention relates, generally, to silk screening devices; more particularly, to multi-color silk screening devices, which feature an integrated heat press unit.

BACKGROUND

The art of silk screening or screen printing has been used by printers for many decades in order to print multi-colored images on textiles. Silk screen devices typically operate by impressing an image on a garment by passing a dye soaked squeegee over a stencil with the desired image. These devices allow a myriad of multi-colored images to be imprinted through multiple passes of the squeegee while using different stencils. Also heat press units (also referred to as embossing units or press-thermoprinters) have been developed and used in garment production for printing, fusing certain materials to textiles, preparation of shirt collars and cuffs, and further such applications. Heat press units may be used in order to print images and/or to fuse objects to the garment.

Oftentimes, for the production of garments that use both silk screening and heat pressing, the garment first is placed on the silk screen device for screen printing. Then, once silk screening operations are completed, the garment is moved from the silk screening device to the heat pressing device for further operations. This multi-step procedure, however, is inefficient because a separate machine must be used for each step of the process, the machines consume valuable floor space in a production facility, the garment must be moved from machine to machine, and the garment must be re-aligned on the platen of the second machine, once it is moved. Furthermore, the lack of an integrated in-line heat press in the multi-step procedure prevents exact registration, such that the multi-step procedure is unable to achieve highly consistent results.

In order to address this inefficiency, several machines have been developed, which integrate heat pressing and silk screening into a single machine. Such devices, however, are limited to large and complicated mass-production machines. For producing samples and/or small quantities of articles, manufacturers continue to be limited to the use of multiple machines and the inefficient procedure discussed above.

Thus, there remains a long felt need in the art for a silk screening apparatus with an integrated apparatus to perform heat pressing using a single unit without the need to remove or reposition the garment.

SUMMARY OF THE INVENTION

This invention is directed towards overcoming the above shortcomings and others. The invention relates to a manually operated silk screen apparatus that includes an integrated heat pressing unit. Embodiments of the invention represent substantial improvements upon the prior art by disclosing, for example, a single apparatus that allows both silk screening and heat pressing procedures to be performed on a garment, without the need to remove or reposition the garment on the apparatus.

The apparatus comprises a frame, which mounts the numerous components, including one or more platens, a rail mounted silk screening device, and a rail mounted heat press unit. In one embodiment of the invention, a first platen is located on the device such that it is accessible by both the silk screening device and the heat press unit. In another embodiment, a second platen is also included, which is only accessible by the heat press unit. The frame may also include a pin registration or other alignment device, for aligning silk screen frames to the apparatus and over the first platen. In yet another embodiment of the invention, the silk screening device features a mechanism for pneumatically controlling the pressure and angle of the squeegee.

In one embodiment of the invention, the rail mounted silk screening device comprises a carriage on which the mount for a silk screen squeegee is attached. The carriage is slidably mounted to two first rails at the outer, side edges of the frame such that the carriage may be moved longitudinally over the first platen during silk screening operations. The mount for the silk screen squeegee is attached to the carriage such that it passes over the first platen as the carriage is moved from the rear to the front of the apparatus. The carriage is configured such that a set of vertical columns, which are located adjacent to and above the rails, mount a transverse cross bar at a height above the rails sufficient for all other components of the apparatus to pass below the cross bar when the carriage longitudinally moves the silk screening device such that the cross bar is unobstructed. The cross bar attaches the silk screen mount and the other silk screening accessories. When the silk screening portion of work is completed, the carriage is moved longitudinally to its rearmost position, allowing the heat press unit to move transversely over the frame unobstructed. In another embodiment of the invention, the silk screening device is configured such that the pressure and the angle of the silk screen squeegee is pneumatically controlled.

The frame of the apparatus also mounts a sliding heat press unit. In one embodiment of the invention, the heat press unit is slidably mounted to the frame by attaching to second rails located on the underside of the apparatus and extending transversely. The heat press unit travels transversely in a direction perpendicular to the longitudinal movement of the silk screen device. The heat press unit is allowed to travel transversely between both platens. In this manner, following the completion of silk screening operations by the silk screen device on the first platen, the heat press unit can be promptly moved to a position over the first platen, in order to commence heat pressing. When the heat pressing is completed, the heat press unit can again be transversely moved along the second rails in order that the garment may be removed from the apparatus.

It should be noted that the apparatus may be configured in any number of ways which allow the silk screen device and heat press unit to be used independently of one another and not interfere with one another's movements. In one embodiment, discussed above, the silk screen device articulates longitudinally supported by columns extending vertically upwards from the rails, and the heat press unit articulates transversely on second rails mounted to the underside of the apparatus. However, it remains within the contemplation of the invention that the apparatus may be configured such that the heat press unit and silk screen device move parallel or perpendicular to each other. Also, the first and second mounting rails may be configured to both extend vertically upwards, both extend vertically downwards, both extend longitudinally, both extend transversely, extend in opposite directions to each other, or extend perpendicularly to each other, as in the embodiment discussed above. Also, the heat press unit may be mounted on rails, mounted axially in a swing-away configuration, mounted in a clamshell mounting, or mounted using any other mounting means known in the art. These variations remain within the contemplation of the invention. Furthermore, the apparatus can be made in various sizes to accommodate different embellishment areas.

The invention therefore relates to a silk screening device, which includes a heat press unit and is configured such that silk screening and heat pressing operations may be performed on the same unit without the need to remove or reposition the garment.

DETAILED DESCRIPTION OF THE DRAWINGS

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

In the following description, certain terminology is used to describe certain features of one or more embodiments of the invention. For instance, "silk screen device" refers to any of the single or multi-colored traveling-inker stenciling device known in the art; "heat press unit" refers to any heat press, embossing press, heat thermoprinter, or other heat transfer press device known in the art; and "article" refers to any garment, paper, fabric, or other such device commonly printed upon using silk screening and heat press devices.

Figure 1:
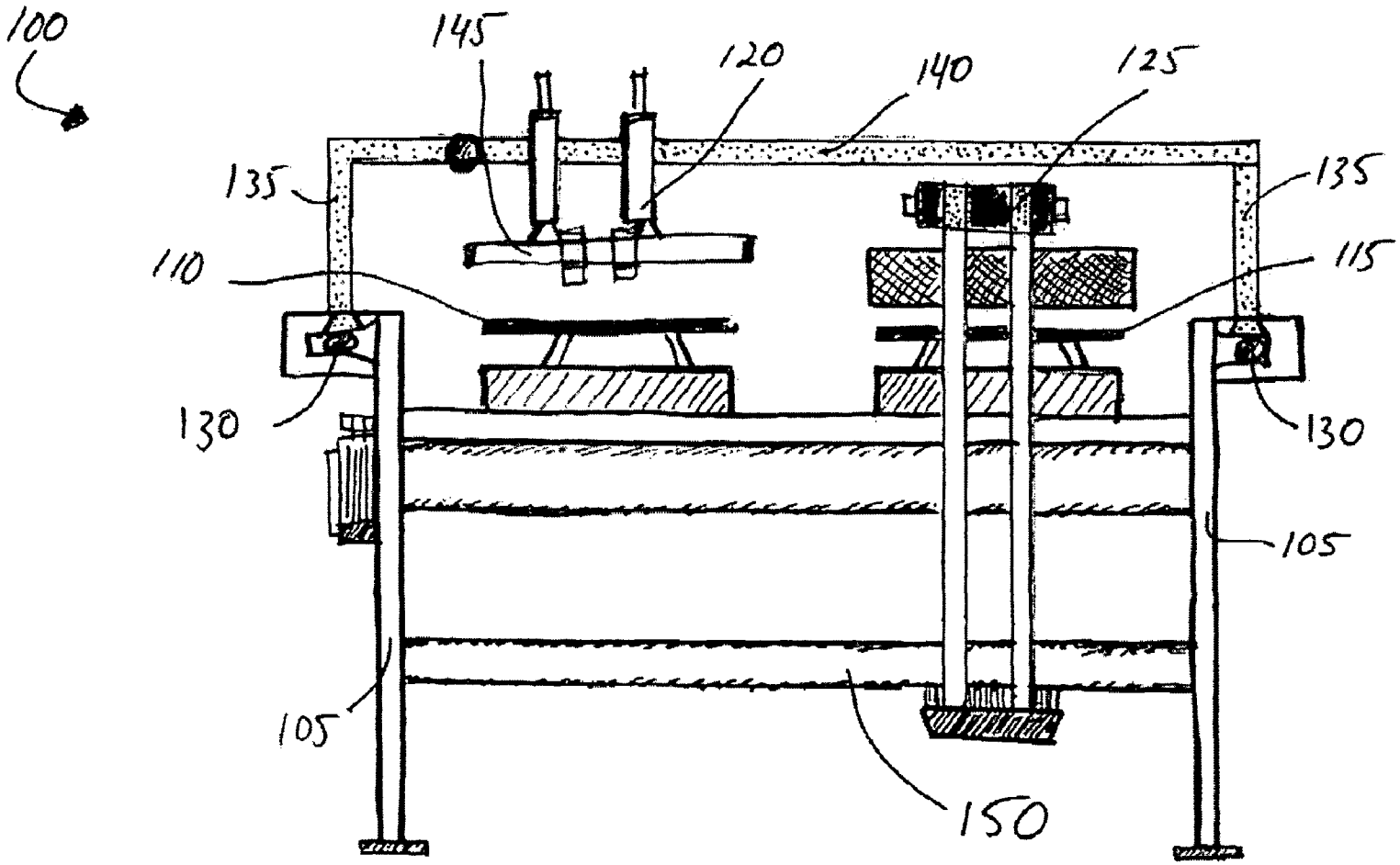
FIG. 1 is an illustration from a front view of one embodiment of the invention.

FIG. 1 is an illustration from a front view of one embodiment of the invention. A silk screen sample apparatus with integrated heat press device 100 is shown along with its constituent parts, including, the frame 105, the first platen 110, the second platen 115, the silk screen device 120, and the heat press unit 125. The silk screen device 120 is mounted on first rails 130 extending longitudinally and features columns 135 extending vertically, which suspend the cross bar 140 that attaches the silk screen squeegee mount 145. By sliding the columns 135 longitudinally along the rails 130, the silk screen device 120 is allowed to pass over the first platen 110. The heat press unit 125, meanwhile, features second rails 150 extending transversely, which allow the heat press unit 125 to move transversely to operate on either the first platen 110 or the second platen 115.

Figure 2:
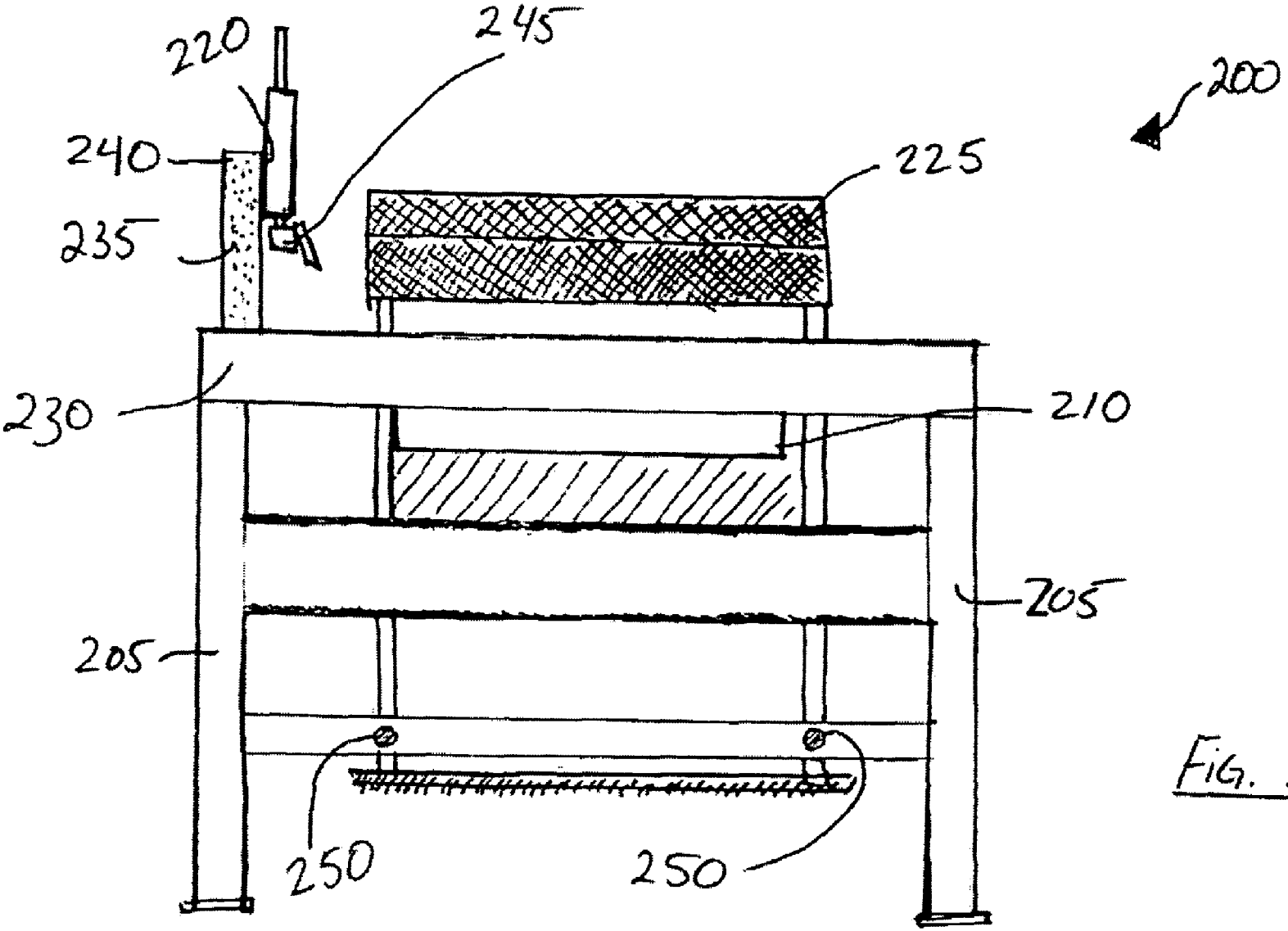
FIG. 2 is an illustration from a side view of one embodiment of the invention.

FIG. 2 is an illustration from a side view of one embodiment of the invention. A silk screen sample apparatus with integrated heat press device 200 is shown along with its constituent parts, including, the frame 205, the first platen 210, the silk screen device 220, and the heat press unit 225. The silk screen device 220 is mounted on first rails 230 extending longitudinally and features columns 235 extending vertically, which suspend the cross bar 240 that attaches the silk screen squeegee mount 245. By sliding the columns 235 longitudinally along the rails 230, the silk screen device 220 is allowed to pass over the first platen 210. The heat press unit 225, meanwhile, features second rails 250 extending transversely, which allow the heat press unit 225 to move transversely to operate on either the first platen 210 or the second platen (obscured in the side view of FIG. 2).

Figure 3:
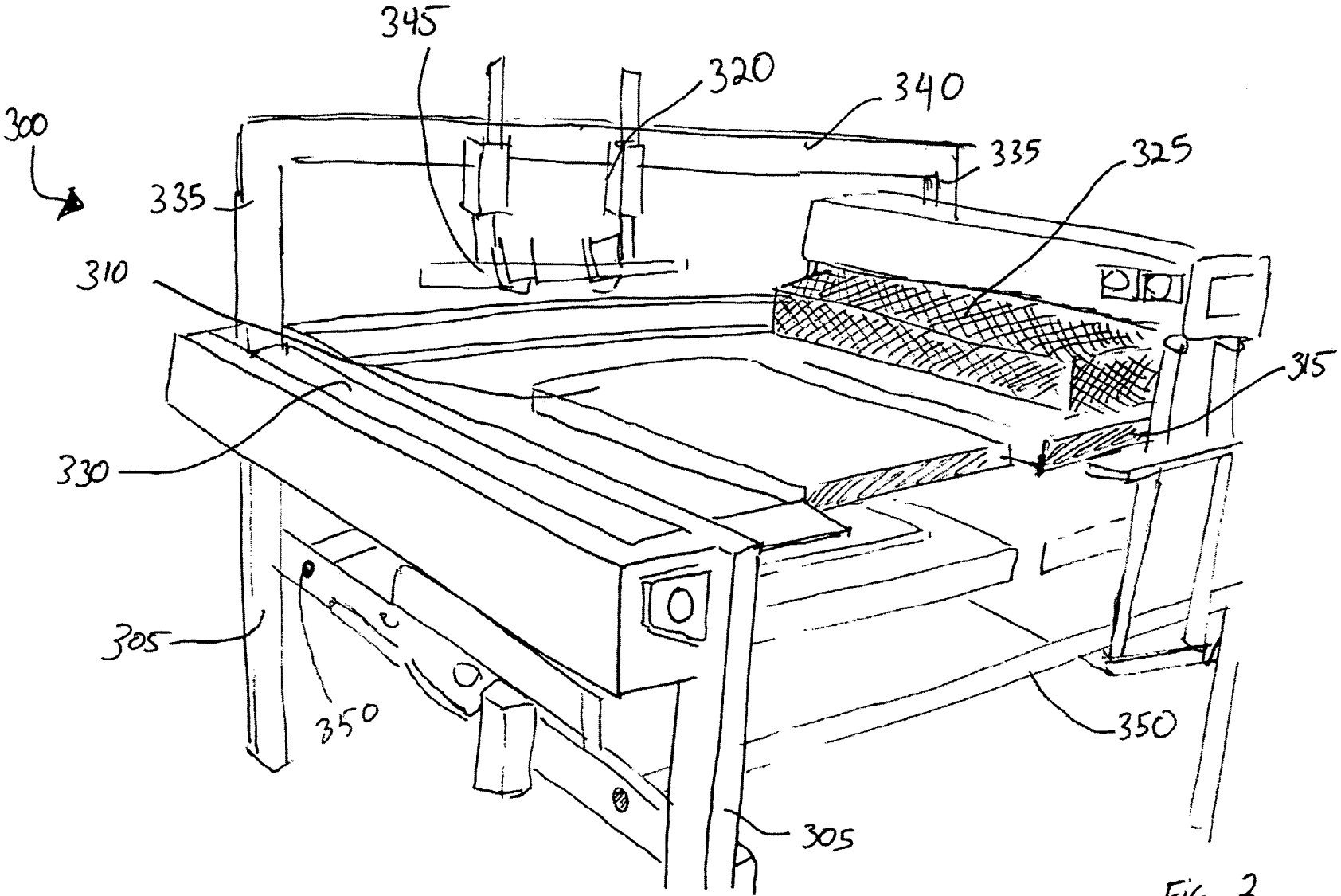
FIG. 3 is an illustration from a perspective view of one embodiment of the invention.

FIG. 3 is an illustration from a perspective view of one embodiment of the invention. A silk screen sample apparatus with integrated heat press device 300 is shown along with its constituent parts, including, the frame 305, the first platen 310, the second platen 315, the silk screen device 320, and the heat press unit 325. The silk screen device 320 is mounted on first rails 330 extending longitudinally, and features columns 335 extending vertically, which suspend the cross bar 340 that attaches the silk screen squeegee mount 345. By sliding the columns 335 longitudinally along the first rails 330, the silk screen device 320 is allowed to pass over the first platen 310. The heat press unit 325, meanwhile, features second rails 350 extending transversely, which allow the heat press unit 325 to move transversely to operate on either the first platen 310 or the second platen 315.

Figure 4:
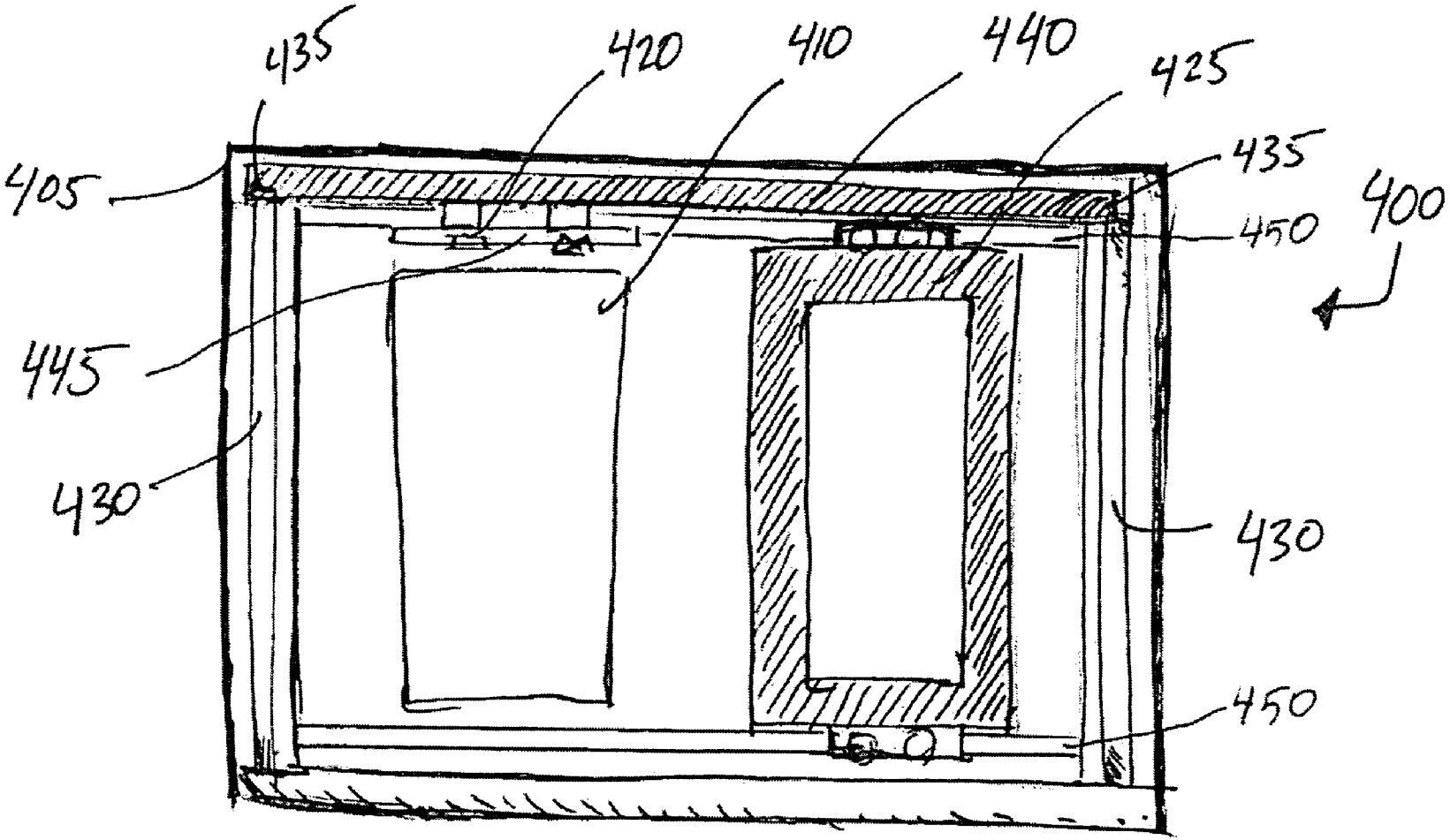
FIG. 4 is an illustration from a top view of one embodiment of the invention.

FIG. 4 is an illustration from a top view of one embodiment of the invention. A silk screen sample apparatus with integrated heat press device 400 is shown along with its constituent parts, including, the frame 405, the first platen 410, the second platen (obscured in the top view of FIG. 4), the silk screen device 420, and the heat press unit 425. The silk screen device 420 is mounted on first rails 430 extending longitudinally, and features columns 435 extending vertically, which suspend the cross bar 440 that attaches the silk screen squeegee mount 445. By sliding the columns 435 longitudinally along the first rails 430, the silk screen device 420 is allowed to pass over the first platen 410. The heat press unit 425, meanwhile, features second rails 450 extending transversely, which allow the heat press unit 425 to move transversely to operate on either the first platen 410 or the second platen.

What is claimed is:

1. A silk screen and heat press apparatus, comprising:

a frame, said frame being configured to mount components of said silk screen and heat press apparatus, wherein said components include:

a platen mounted to said frame, said platen being configured to removably mount an article for silk screening and heat pressing operations, a frame holder, said frame holder being configured to removably attach silk screening frames to said frame, a silk screen squeegee mount, said silk screen squeegee mount being slidably attached to said frame such that said silk screen squeegee mount may pass over said platen for silk screening articles on said platen, a heat press unit, said heat press unit being movably attached to said frame such that said heat press unit has two or more positions including a first position where said heat press unit can perform heat pressing on articles placed on said platen and a second position such that said heat press unit is removed from said platen and said silk screen squeegee mount may pass unobstructed over said platen.

2. A silk screen and heat press apparatus according to claim 1, wherein said heat press unit is a clam-shell type heat press unit.

3. A silk screen and heat press apparatus according to claim 1, wherein said heat press unit is a swing-arm type heat press unit.

4. A silk screen and heat press apparatus according to claim 1, wherein said heat press unit is a vertically articulating heat press unit.

5. A silk screen and heat press apparatus according to claim 1, wherein said frame holder includes a pin registration system for the alignment of silk screening frames.

6. A silk screen and heat press apparatus, comprising:

a frame having outside edges, said frame being configured to mount the components of said silk screen and heat press apparatus, wherein said components include:

a platen mounted to said frame, said platen being configured to removably mount an article for silk screening and heat pressing operations, a frame holder, said frame holder being configured to removably attach silk screening frames to said frame, a first set of rails, said rails being located adjacent to two opposite outside edges of said frame and said first set of rails being configured to slidably mount a set of columns, said columns being mounted to said first set of rails such that bases of said columns are slidably attached to said first set of rails and crowns of said columns attach to a cross bar, said cross bar being generally horizontal and extending between said columns, and said cross bar attaching a silk screen squeegee mount, said silk screen squeegee mount being slidably attached to said cross bar such that said silk screen squeegee mount may pass over said platen for silk screening articles on said platen, a second set of rails mounted to said frame, said second set of rails being configured to slidably mount a heat press unit, said heat press unit being slidably attached to said second set of rails such that said heat press unit has two or more positions including a first position where said heat press unit can perform heat pressing on articles placed on said platen and a second position such that said heat press unit is removed from said platen such that said silk screen squeegee mount may pass over said platen without being obstructed by said heat press unit.

7. A silk screen and heat press apparatus according to claim 6, wherein said heat press unit is a clam-shell type heat press unit.

8. A silk screen and heat press apparatus according to claim 6, wherein said heat press unit is a swing-arm type heat press unit.

9. A silk screen and heat press apparatus according to claim 6, wherein said heat press unit is a vertically articulating heat press unit.

10. A silk screen and heat press apparatus according to claim 6, wherein said frame holder includes a pin registration system for the alignment of silk screening frames.

11. A silk screen and heat press apparatus according to claim 6, wherein said second set of rails is generally perpendicular to said first set of rails.

12. A silk screen and heat press apparatus according to claim 11, wherein said second set of rails is mounted to a portion of the frame vertically below said platen.

13. A silk screen and heat press apparatus according to claim 12, wherein said columns and cross bar are configured such that said cross bar is mounted vertically higher than said heat press unit such that said cross bar can slidably move without being obstructed by said heat press unit.

14. A silk screen and heat press apparatus according to claim 6, wherein said second set of rails is generally parallel to said first set of rails.

15. A silk screen and heat press apparatus according to claim 6, wherein said silk screen squeegee mount includes pneumatic controls configured to regulate pressures and angles with which the silkscreen squeegee mount is vertically articulated with respect to the platen.

16. A silk screen and heat press apparatus according to claim 15, wherein the articulation of said heat press unit is controlled by a pneumatic pressure system.

17. A silk screen and heat press apparatus according to claim 6, wherein articulation of said heat press unit is controlled by a pneumatic pressure system.

18. A silk screen and heat press apparatus, comprising:

a frame having outside edges, said frame being configured to mount the components of said silk screen and heat press apparatus, wherein said components include:

a first platen mounted to said frame, said platen being configured to removably mount an article for silk screening and heat pressing operations, a frame holder, said frame holder being configured to removably attach silk screening frames to said frame at a location over said first platen, a first set of rails, said rails being located adjacent to two opposite outside edges of said frame and said first set of rails being configured to slidably mount a set of columns, said columns being mounted to said first set of rails such that bases of said columns are slidably attached to said first set of rails and crowns of said columns attach to a cross bar, said cross bar being generally horizontal and extending between said columns, and said cross bar attaching a silk screen squeegee mount, said silk screen squeegee mount being slidably attached to said cross bar such that said silk screen squeegee mount may pass over said first platen for silk screening articles on said platen, a second platen, said second platen located such that said silk screen squeegee mount does not pass over said second platen, a second set of rails mounted to said frame, said second set of rails being fixedly attached to said frame at a location generally below said first platen and said second platen, said second set of rails being perpendicular to said first said of rails, a heat press unit, said heat press unit being vertically articulating and said heat press unit being slidably attached to said second set of rails such that said heat press unit has two or more positions including a first position where said heat press unit can perform heat pressing on articles placed on said first platen and a second position such that said heat press unit is removed from said first platen and said silk screen squeegee mount may pass over said first platen.

19. A silk screen and heat press apparatus according to claim 18, wherein said silk screen squeegee mount includes pneumatic controls configured to regulate pressures and angles with which the silk screen mount is vertically articulated with respect to the first platen.

20. A silk screen and heat press apparatus according to claim 19, wherein articulation of said heat press unit is controlled by a pneumatic pressure system.

21. A silk screen and heat press apparatus according to claim 18, wherein articulation of said heat press unit is controlled by a pneumatic pressure system.

* * * * *